US010415838B2

(12) United States Patent
Kim et al.

(10) Patent No.: US 10,415,838 B2
(45) Date of Patent: Sep. 17, 2019

(54) PORTABLE AIR CONDITIONER

(71) Applicant: LG ELECTRONICS INC., Seoul (KR)

(72) Inventors: Moohee Kim, Seoul (KR); Donghwal Lee, Seoul (KR); Hyuckjae Kwon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 245 days.

(21) Appl. No.: 15/178,356

(22) Filed: Jun. 9, 2016

(65) Prior Publication Data

US 2016/0363330 A1 Dec. 15, 2016

(30) Foreign Application Priority Data

Jun. 10, 2015 (KR) ..... 10-2015-0081872

(51) Int. Cl.

| | |
|---|---|
| ***F25D 23/12*** | (2006.01) |
| ***F24F 1/04*** | (2011.01) |
| ***F24F 1/027*** | (2019.01) |
| ***F24F 13/02*** | (2006.01) |
| ***F24F 13/20*** | (2006.01) |
| ***F24F 13/12*** | (2006.01) |
| ***F24F 1/022*** | (2019.01) |

(52) U.S. Cl.

CPC ..... *F24F 1/04* (2013.01); *F24F 1/022* (2013.01); *F24F 1/027* (2013.01); *F24F 13/0218* (2013.01); *F24F 13/12* (2013.01); *F24F 13/20* (2013.01); *F24F 2221/125* (2013.01)

(58) Field of Classification Search

CPC ..... F24F 13/0218; F24F 13/12; F24F 13/20; F24F 13/0254; F24F 13/0272; F24F 1/025; F24F 1/027; F24F 1/04; F24F 2221/125

See application file for complete search history.

(56) References Cited

U.S. PATENT DOCUMENTS

| | | | | |
|---|---|---|---|---|
| 4,955,106 A * | 9/1990 | Stein | ..... | A47L 5/32 15/323 |
| 6,125,585 A * | 10/2000 | Koneval | ..... | E05F 15/643 49/349 |
| 9,644,852 B2 * | 5/2017 | Guercio | ..... | F24F 13/222 |
| 9,829,896 B1 * | 11/2017 | Arend | ..... | G05D 23/19 |

(Continued)

FOREIGN PATENT DOCUMENTS

| | | |
|---|---|---|
| CN | 101178244 A | 5/2008 |
| CN | 201790734 U | 4/2011 |

(Continued)

*Primary Examiner* — Edward F Landrum
*Assistant Examiner* — Kamran Tavakoldavani
(74) *Attorney, Agent, or Firm* — Dentons US LLP

(57) ABSTRACT

A portable air-conditioner includes a case in which a condenser and an evaporator are integrally installed and an inlet and an outlet are formed; and an exhaust unit integrally coupled to the case and guiding air heat-exchanged with the condenser to an outdoor area, wherein the exhaust unit includes an exhaust pipe fixed to the case in one end thereof, disposed to be at least partially inserted into the case, and having a portion, excluding the one end, spaced apart from the case; and a shielding module installed in a window, fixed to the other end of the exhaust pipe, and detachably received in the case.

13 Claims, 9 Drawing Sheets

(56) References Cited

U.S. PATENT DOCUMENTS

| | | | | |
|---|---|---|---|---|
| 2008/0093843 | A1* | 4/2008 | Noroozi | B60H 1/00564 285/81 |
| 2009/0124192 | A1* | 5/2009 | Ku | F24F 1/025 454/367 |
| 2012/0117752 | A1 | 5/2012 | Sever et al. | |
| 2016/0097547 | A1* | 4/2016 | Selg | F24F 13/20 62/293 |
| 2016/0153670 | A1* | 6/2016 | Choi | F24F 1/025 62/448 |

FOREIGN PATENT DOCUMENTS

| | | | | |
|---|---|---|---|---|
| CN | 102149893 | A | | 8/2011 |
| EP | 0 979 976 | A2 | | 2/2000 |
| KR | 10-0787920 | B1 | | 12/2007 |
| KR | 10-2008-0041065 | A | | 5/2008 |
| KR | 10-2008-0075258 | A | | 8/2008 |
| KR | 20080075258 | A | * | 8/2008 |
| KR | 20080075258 | A | * | 8/2008 |
| KR | 10-2009-0125975 | A | | 12/2009 |

* cited by examiner

PORTABLE AIR CONDITIONER

CROSS-REFERENCE TO RELATED APPLICATION

The Application present application claims priority under 35 U.S.C. § 119 and 35 U.S.C. § 365 to Korean Patent No. 10-2015-0081872 (filed on Jun. 10, 2015), which is hereby incorporated by reference in its entirety.

BACKGROUND OF THE INVENTION

Field of the Invention

The present invention relates to a portable air-conditioner.

Related Art

In general, air-conditioners include components such as a compressor, an outdoor heat exchanger, an expansion valve, and an indoor heat exchanger.

Air-conditioners are used to maintain an indoor temperature at a set temperature or make an indoor area a pleasant environment.

Air-conditioners are installed in an indoor space or on a wall of vehicles, offices, or homes to cool or heat the indoor area.

Air-conditioners implement a refrigerating cycle or a heat pump cycle in which a refrigerant flows in a compressor, an outdoor heat exchanger, an expansion valve (capillary), and an indoor heat exchanger.

In general, separation-type air-conditioners including an indoor unit and an outdoor unit are used.

A portable air-conditioner is installed in a building in which it is difficult to install the separation type air-conditioner. One type of air conditioner is a portable air conditioner, such as disclosed in related art Korean Patent Laid-Open Publication No. 10-2006-0026757.

The portable air-conditioner has wheels and may be moved to a position intended by a user. The portable air-conditioner has a structure in which a condenser and an evaporator are installed in a main body thereof, and is used only for performing cooling.

Here, air heat-exchanged with the evaporator is discharged to an indoor area to cool indoor air, and air heat-exchanged with the condenser is discharged outwardly through an exhaust pipe. To this end, the portable air-conditioner has the exhaust pipe guiding air heat-exchanged with the condenser to the outside.

The related art portable air-conditioner is manufactured such that the exhaust pipe is detachably attached to the main body.

The exhaust pipe of the related art portable air-conditioner is coupled to the main body only when used, and when the exhaust pipe is not in use, the exhaust pipe is required to be received in an extra space after being separated from the main body.

Thus, the related art portable air-conditioner has a problem in that an extra receiving space is required to keep the exhaust pipe in storage.

Also, since the related art portable air-conditioner has the structure in which the exhaust pipe is detachably attached, assembly components (for example, a bolt, a screw, and the like) required for attaching and detaching the exhaust pipe are required, and when the exhaust pipe is separated and kept for storage, the assembly components may be lost.

In addition, the exhaust pipe of the related art portable air-conditioner is very weak for a high load, frequently damaged such as being bent or broken during a process in which the exhaust pipe is kept in storage, causing a problem in that a new exhaust pipe should be purchased due to the damage done in the keeping process.

Moreover, the related art portable air-conditioner is on sale in a state in which the exhaust pipe and the man body are separately packaged, increasing a volume of the product and transportation cost.

SUMMARY OF THE INVENTION

An aspect of the present disclosure provides a portable air-conditioner in which an exhaust unit discharging air heat-exchanged with a condenser to an outdoor area is integrally manufactured with a case.

Another aspect of the present disclosure provides a portable air-conditioner including an exhaust unit in which an exhaust pipe and a shielding module are integrated.

Another aspect of the present disclosure provides a portable air-conditioner having a shielding module easily installed in a window.

Another aspect of the present disclosure provides a portable air-conditioner having a structure in which an exhaust unit integrally manufactured with a case is effectively received.

Another aspect of the present disclosure provides a portable air-conditioner not requiring an extra receiving space for keeping an exhaust unit in storage.

Another aspect of the present disclosure provides a portable air-conditioner in which an exhaust unit is integrally manufactured with a case, minimizing an installation time and an installation process.

Another aspect of the present disclosure provides a portable air-conditioner in which a protruding thickness of an exhaust unit in a state of being received in a case is minimized.

Another aspect of the present disclosure provides a portable air-conditioner in which a packaging volume is minimized.

Another aspect of the present disclosure provides a portable air-conditioner in which an extra assembly component to be used for assembling an exhaust pipe is not required.

Technical subjects of the present invention that may be obtained in the present invention are not limited to the foregoing technical subjects and any other technical subjects not mentioned herein may be easily understood by a person skilled in the art from the present disclosure and accompanying drawings.

According to an aspect of the present disclosure, a portable air-conditioner may include: a case in which a condenser and an evaporator are integrally installed and an inlet and an outlet are formed; and an exhaust unit integrally coupled to the case and guiding air heat-exchanged with the condenser to an outdoor area, wherein the exhaust unit includes an exhaust pipe fixed to the case in one end thereof, disposed to be at least partially inserted into the case, and having a portion, excluding the one end, spaced apart from the case; and a shielding module installed in a window, fixed to the other end of the exhaust pipe, and detachably received in the case.

The shielding module may include: a first shielding part fixed to the exhaust pipe, having an opening communicating with the exhaust pipe, and outwardly discharging air guided through the exhaust pipe; and a second shielding part coupled to the first shielding part and slidably moved along the first shielding part.

A stopper limiting the slidable movement may be disposed in any one of the first shielding part and the second shielding part.

A grid may be formed in the opening, and air heat-exchanged with the condenser may be discharged through the grid.

A rail may be formed on any one of the first shielding part and the second shielding part, and a guide moved along the rail may be may be formed on the other of the first shielding part and the second shielding part.

A stopper limiting slidable movement may be further disposed on the rail.

The exhaust pipe and the first shielding part may be coupled through at least any one of adhesive fixing, clamping fixing, and fastening fixing.

The shielding module may further include: a third shielding part coupled to the second shielding part and slidably moved along the second shielding part.

The exhaust pipe may be a corrugate tube with creases formed in a length direction.

The creases of the corrugate tube may be disposed in a longitudinal direction.

The exhaust pipe may have an oval shape, and an exhaust pipe insertion recess into which the exhaust pipe is inserted may be formed in the case in a shorter axis direction of the exhaust tube.

The exhaust pipe and the shielding module may be coupled to have a T shape.

The case further may have a shielding coupling recess in which the shielding module is received, and the shielding module may be horizontally installed in the shielding coupling recess.

The shielding coupling recess and the exhaust pipe insertion recess may be connected to each other.

The first shielding part, the second shielding part, and the third shielding part in a stacked state may be inserted into the shielding coupling recess, and the shielding module may form mutual arrest with the shielding coupling recess.

The portable air-conditioner of the present disclosure has one or more advantages as follows.

First, since the exhaust pipe integrally installed in the case and the shielding module installed in a window are integrally manufactured, an extra assembling process is not required.

Second, since the exhaust unit including the exhaust pipe and the shielding module is integrally manufactured with the case, the exhaust unit may be easily received and kept in storage.

Third, since the exhaust unit is integrated with the case, the exhaust unit may be easily moved, and since the received exhaust is separated to be installed in an installation position, an installation time and an installation process may be significantly simplified.

Fourth, since the exhaust unit is insertedly installed in the case, a protruding thickness thereof may be minimized.

Fifth, since the exhaust pipe fixing unit is formed upwards, a protruding length of the exhaust pipe from the case may be minimized.

Sixth, since the exhaust pipe has an oval shape, a protruding length due to the exhaust pipe may be minimized.

Seventh, since the exhaust pipe and the shielding module are coupled to have a T shape and inserted into the shielding coupling recess in the state of being coupled in the T shape, the exhaust pipe and the shielding module may form mutual arrest with the case.

Eighth, the exhaust pipe may be formed as a corrugate tube, and the shielding module may be maintained in a state of being coupled to the shielding coupling recess by elastic force of the corrugate tube.

Ninth, since the first shielding part, the second shielding part, and the third shielding part in a stacked state are inserted into the shielding coupling recess in a horizontal direction, the shielding module may be firmly coupled to the shielding coupling recess.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE EMBODIMENTS

Figure 1:
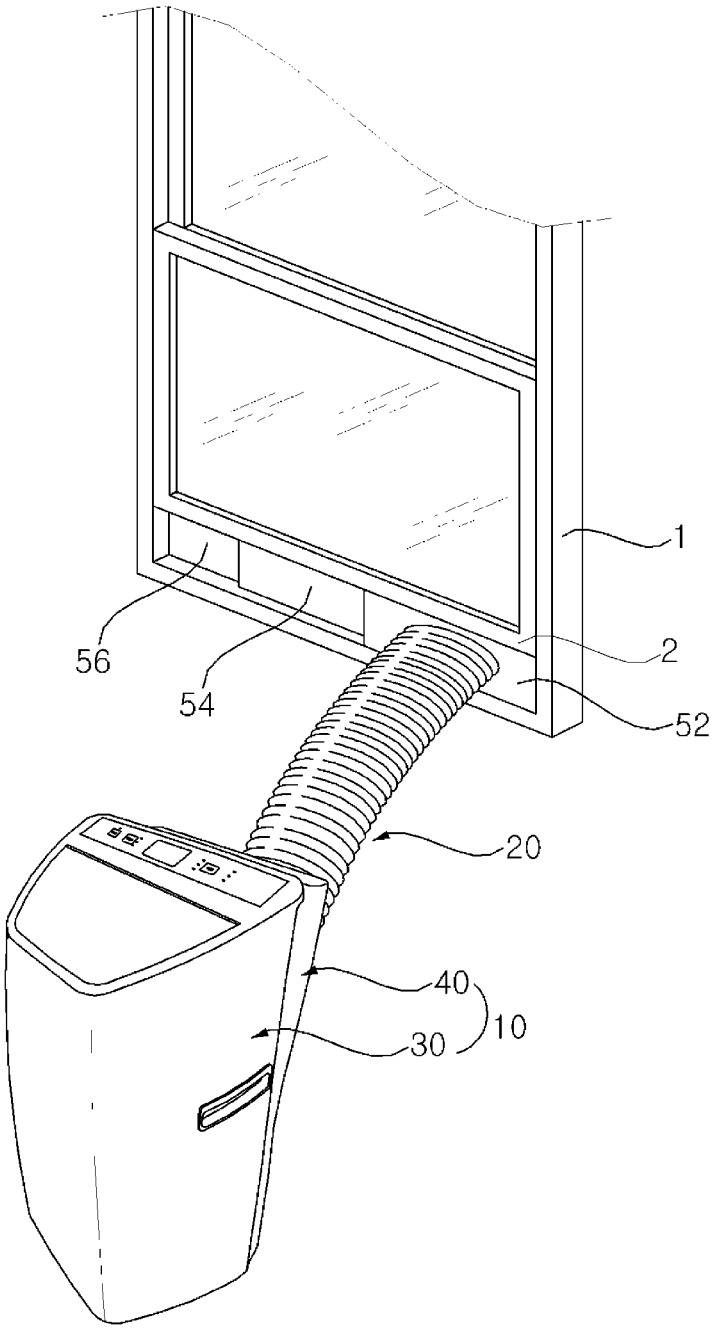
FIG. 1 is a perspective view illustrating installation of a portable air-conditioner according to a first embodiment of the present disclosure.
Figure 2:
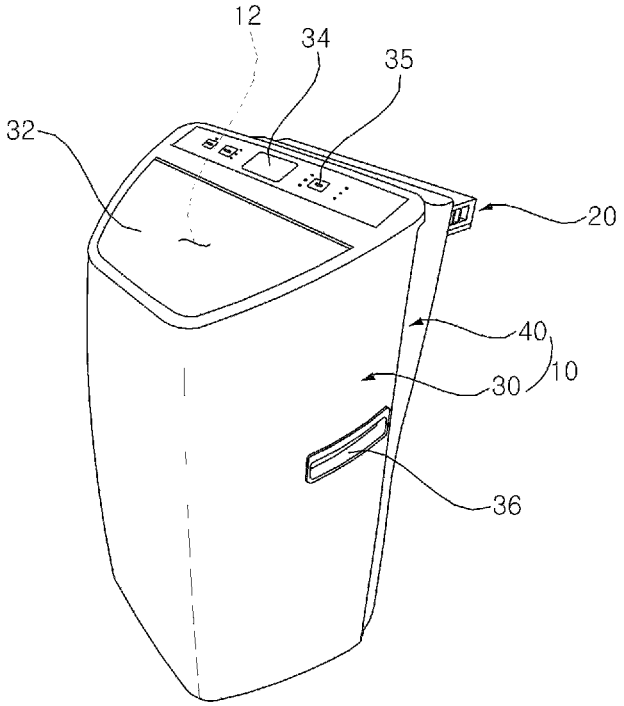
FIG. 2 is a perspective view of the portable air-conditioner illustrated in FIG. 1.
Figure 3:
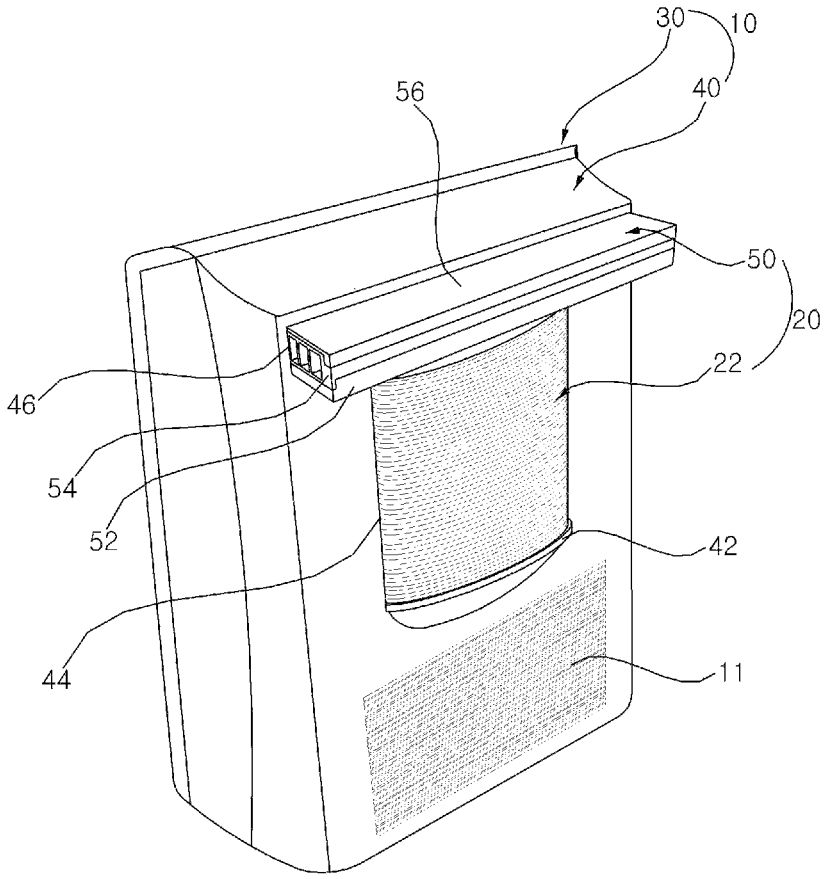
FIG. 3 is a perspective view illustrating a rear side of the portable air-conditioner of FIG. 2.
Figure 4:
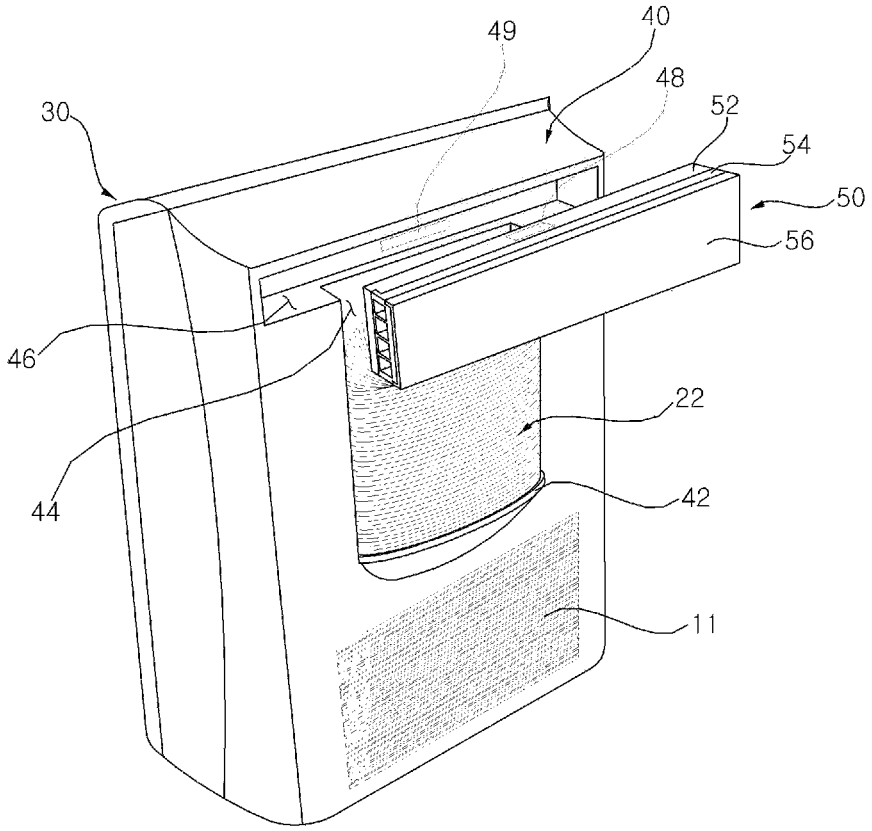
FIG. 4 is a perspective view illustrating a shielding module of FIG. 2 is separated.
Figure 5:
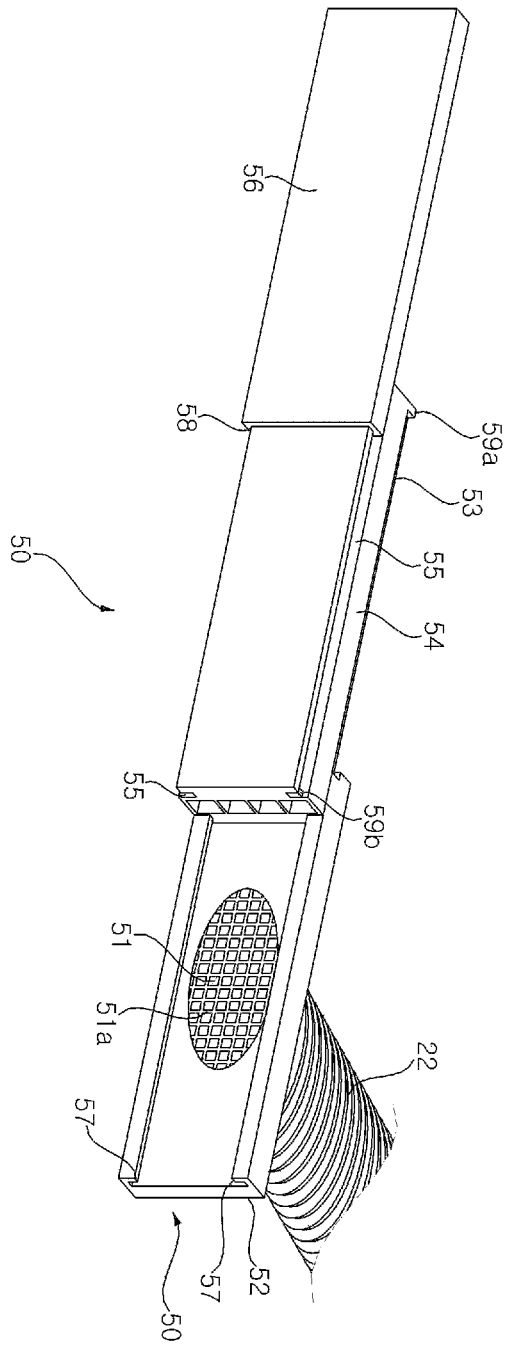
FIG. 5 is a view illustrating an expanded state of the shielding module illustrated in FIG. 2.
Figure 6:
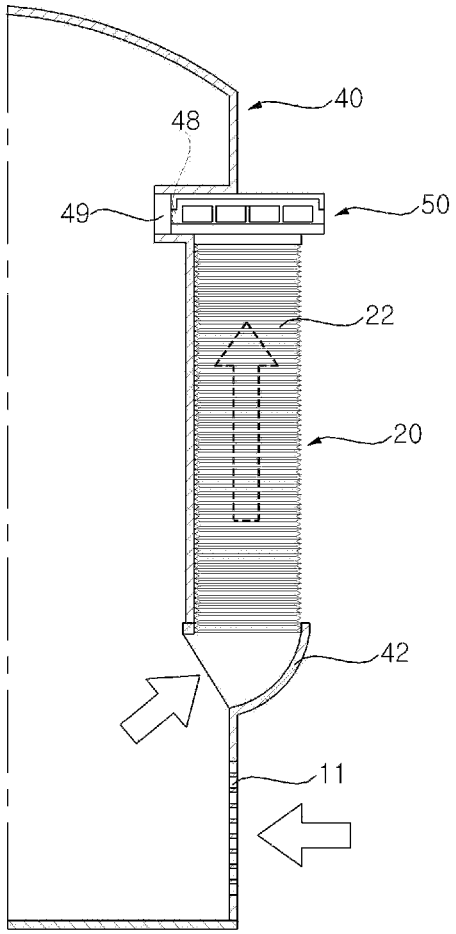
FIG. 6 is a cross-sectional view illustrating an installation of an exhaust unit illustrated in FIG. 3.
Figure 7:
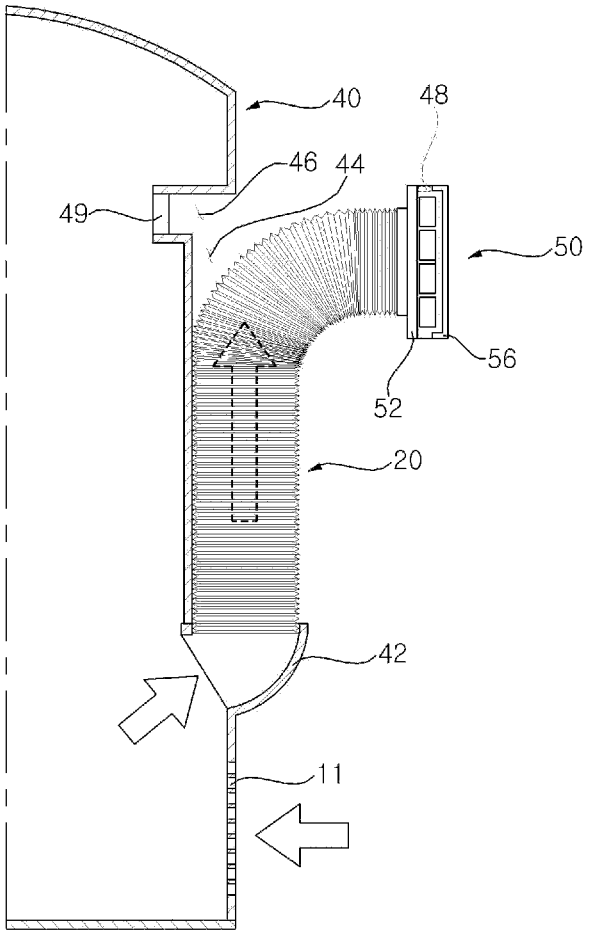
FIG. 7 is a view illustrating a way in which the exhaust unit illustrated in FIG. 6 is used.

Hereinafter, embodiments of the present disclosure will be described in detail with reference to the accompanying drawings.

A portable air-conditioner according to a first embodiment of the present disclosure will be described with reference to FIGS. 1 to 7.

The potable air-conditioner according to the present disclosure includes a case 10 including an inlet (or an intake) 11 and an outlet 12 (or a discharge opening) and an exhaust unit 20 integrally coupled to the case 10.

The case 10 includes a front case 30 and a rear case 40.

A wheel (not shown) is disposed on a lower portion of the case 10.

A discharge cover 32 opening and closing the outlet 12 is disposed on the front case 30.

An operation button 35 receiving an operation signal from a user and a display 34 are disposed on the front case 30.

A handle unit 36 is formed on a side portion of the front case 30.

The exhaust unit 20 is integrally coupled to the rear case 40.

The inlet 11 is formed in a lower portion of the rear case 40.

The exhaust unit 20 is positioned above the inlet 11.

A portion of the exhaust unit 20 is inserted into the rear case 40 and the other remaining portion protrudes outwardly.

A compressor, a condenser, an expansion valve, an evaporator, and a blow fan provided within the case 10 to provide a refrigerating cycle of a refrigerant.

In the present disclosure, a portion of air intake through the inlet 11 is heat-exchanged with the condenser and subsequently discharged outwardly through the exhaust unit 20.

The other remaining portion of the intaken air is heat-exchanged with the evaporator and discharged to an indoor area through the outlet 12.

Unlike the present embodiment, two inlets may be provided, and in this case, air intaken from one inlet may be heat-exchanged with the condenser and subsequently discharged outwardly, and air intake from the other inlet may be heat-exchanged with the evaporator and subsequently discharged to the indoor area.

In this manner, a structure of the refrigerating cycle may be variously implemented according to design conditions. Also, a person skilled in the art may variously configure an air flow path structure according to design conditions.

The exhaust unit 20 may be positioned above the rear case 40 and connected to the window.

The exhaust unit 20 may be disposed below the rear case 40, and in this case, a connection length with the window may be increased.

The exhaust unit 20 may include an exhaust pipe 22 fixedly coupled to the rear case 40 and a shielding module 50 fixed to an end of the exhaust pipe 22 and fixed to the window.

The exhaust pipe 22 and the shielding module 50 are coupled to have a T shape.

An exhaust pipe fixing part 42 to which one end of the exhaust pipe 22 is fixed is formed on the rear case 40.

The exhaust pipe fixing part 42 is formed to face upwardly.

One end of the exhaust pipe 22 is fixed to the exhaust pipe fixing part 42.

The exhaust pipe fixing part 42 is formed such that one end of the exhaust pipe 22 is partially inserted into an inner side of the rear case 40.

The exhaust pipe fixing part 42 may minimize an outwardly protruding thickness of the coupled exhaust pipe 22.

In particular, the exhaust pipe fixing part 42 formed to face upwardly may minimize a bent or protruding thickness of the exhaust pipe 22.

An exhaust pipe insertion recess 44 allowing the exhaust pipe 22 to be partially inserted therein is formed above the exhaust pipe fixing part 42 on the rear case 40.

A shielding coupling recess 46 is formed on the rear case 40, and the shielding module 50 is partially inserted into an upper portion of the exhaust pipe insertion recess 44.

The shielding coupling recess 46 and the exhaust pipe insertion recess 44 are connected to each other.

The exhaust pipe fixing part 42 communicates with an interior of the rear case 40 to guide air.

The exhaust pipe fixing part 42 is formed to face upwardly. Unlike the present disclosure, the exhaust pipe fixing part 42 may also be configured to rotate at a predetermined angle with respect to the rear case 40.

The exhaust pipe fixing part 42 is positioned above the inlet 11.

Since the exhaust pipe fixing part 42 is disposed above the inlet 11, flow resistance of air may be minimized.

The exhaust pipe 22 is formed of a synthetic resin material having elasticity.

The exhaust pipe 22 is manufactured in the form of a corrugate tube. Creases of the corrugate tube may be disposed in a longitudinal direction.

The exhaust pipe 22 formed as a corrugate tube is received in a shrunken state in the rear case 40. When the exhaust pipe 22 formed as a corrugate tube is installed in the window, a distance between the creases may be increased.

The exhaust pipe 22 is formed such that a cross-section thereof perpendicular to an air flow direction has an oval shape.

The oval exhaust pipe 2 is disposed such that a longer axis thereof is in a traverse direction o the rear case 40 and a shorter axis thereof is in a forward/backward direction of the rear case 40.

The exhaust pipe 22 is partially inserted into the exhaust pipe insertion recess 44.

The exhaust pipe 22 is inserted into the exhaust pipe insertion recess 44 in a shorter axis direction.

Thus, a thickness of the exhaust pipe 22 protruding from the rear surface of the rear case 40 may be minimized.

The oval shape of the exhaust pipe 22 facilitates installation of the exhaust pipe 22.

Since the exhaust pipe 22 is installed in the window positioned at a further rear side on the back of the case 100 and a bent forward/backward direction thereof is a shorter axis direction, the exhaust pipe 22 is easily deformed.

One end of the exhaust pipe 22 may be fixedly adhered to the exhaust pipe fixing part 42.

One end of the exhaust pipe 22 may be fixed to the exhaust pipe fixing part 42 through a fastening member (not shown) such as a bolt or a screw.

One end of the exhaust pipe 22 may be fixed to the exhaust pipe fixing part 42 through a connection unit such as a clamp (not shown).

The other end of the exhaust pipe 22 is coupled to the shielding module 50.

The shielding module 50 communicates with the exhaust pipe 22.

The shielding module 50 discharges air guided to the exhaust pipe 22.

The shielding module 50 insertedly fixed to an indoor window.

The shielding module 50 blocks a gap of the open window to prevent ambient air from being introduced to an indoor area and discharges hot air heat-exchanged with the condenser to an outdoor area.

The shielding module 50 prevents discharged air from being introduced again to an indoor area.

The shielding module 50 may be adjusted in length to correspond to a length of the window.

The shielding module 50 is coupled to be perpendicular to the other end of the exhaust pipe 22.

Before being installed on the window, the shielding module 50 is in a state of being coupled to the shielding coupling recess 46 of the rear case 40.

A portion of the shielding module 50 is inserted into the shielding coupling recess 46. The shielding module 50 is partially inserted into the shielding coupling recess 46 and maintained in an insertedly coupled state.

In the present disclosure, the first shielding part, the second shielding part, and the third shielding part in a stacked state are inserted into the shielding coupling recess 46. The shielding module 50 forms mutual arrest with the shielding coupling recess 46 in a longitudinal direction (that is, the shielding module 50 and the shielding coupling recess 46 are mutually caught by each other in the longitudinal direction).

In the present disclosure, additional coupling force is provided using a permanent magnet 48 in order to maintain the shielding module 50 in a more firmly coupled state.

In the present embodiment, the permanent magnet 48 is installed in the shielding module 50 and a magnetic force corresponding member 49 forming magnetic force to correspond to the permanent magnet 48 is provided in the shielding coupling recess 46.

The magnetic force corresponding member 49 may be formed of a metal generating attraction with respect to the permanent magnet 48, or a permanent magnet may be used as the magnetic force corresponding member 49.

The magnetic force corresponding member 49 may be disposed in the shielding coupling recess 46 such that it is exposed, but in the present disclosure, the magnetic force corresponding member 49 is disposed at the inner side of the rear case 40.

The shielding module 50 is includes a first shielding part 52 coupled to the exhaust pipe 22 and discharging air, a second shielding part 54 slidably coupled to the first shielding part 52, and a third shielding part 56 slidably coupled to the second shielding part 54.

The first shielding part 52, the second shielding part 54, and the third shielding part 56 stacked to each other are inserted together into the shielding coupling recess 46.

When inserted into the shielding coupling recess 46, the first shielding part 52, the second shielding part 54, and the third shielding part 56 are sequentially in a state of being stacked.

An overall width of the stacked first shielding part 52, the second shielding part 54, and the third shielding part 56 is partially inserted into the shielding coupling recess 46.

After the shielding module 50 is inserted into the shielding coupling recess 46, the shielding module 50 is pressurized downwardly due to a self-load of the exhaust pipe 22.

The exhaust pipe 22 is formed of an elastic material, tensile force acting in a longitudinal direction is further formed in addition to the self-load.

An opening 51 communicating with the exhaust pipe 22 is formed in the first shielding part 51.

A grid 51*a* may be formed in the opening 51 in order to prevent intrusion of an insect or an animal.

The second shielding part 54 may be slidably moved with respect to the first shielding part 52.

The second shielding part 54 may be slidably moved with respect to the third shielding part 56.

In the present disclosure, a first rail 53 and a second rail 55 are formed in the second shielding part 54.

The first shielding part 52 may be slidably moved along the first rail 53.

A first guide 57 moved along the first rail 53 is formed in the first shielding part 52.

The first guide 57 is formed to extend in a length direction.

The first guide 57 is formed to cover the first rail 53.

The third shielding part 56 may be slidably moved along the second rail 55.

A second guide 58 moving along the second rail 55 is formed in the third shielding part 56.

The second guide 58 is formed to extend in a length direction.

The second guide 58 is formed to cover the second rail 55.

The first shielding part 52, the second shielding part 54, and the third shielding part 56 are slidably moved in a length direction.

The first shielding part 52, the second shielding part 54, and the third shielding part 56 are sequentially stacked.

A first stopper 59*a* limiting a distance of a slidable movement may be formed between the first shielding part 52 and the second shielding part 54.

A second stopper 59*b* limiting a distance of a slidable movement may be formed between the second shielding part 54 and the third shielding part 56.

In the present disclosure, the shielding module 50 is manufactured to have three components, but unlike the present disclosure, only two shielding parts may also be provided.

In the air-conditioner according to the present disclosure, since the exhaust unit 20 is integrally manufactured with the case 10, an extra receiving space for keeping the exhaust unit 20 in storage is not required.

In the air-conditioner according to the present disclosure, since the exhaust unit 20 is in a state of being received in the case 10, after the air-conditioner is moved to an installation space, the exhaust unit 20 may be immediately installed.

In the air-conditioner according to the present disclosure, since the shielding module 50 installed in the window 1 is received in the shielding coupling recess 46, movement and keeping thereof are facilitated.

In the air-conditioner according to the present disclosure, since the exhaust unit 20 is integrally manufactured, time for assembling or separating the exhaust unit 20 to or from the case 10 as in the related art is not required.

Hereinafter, an installation process of the exhaust unit according to the present disclosure will be described in more detail.

First, a user draws out the shielding module 50 from the shielding coupling recess 46.

The user installs the drawn-out shielding module 50 in the window 1.

The user slidably moves the first shielding part 52, the second shielding part 54, and the third shielding part 56 forming the shielding module 50 to adjust them to a width of the window 1.

When the width of the window 1 is small, the second shielding part 54 and the third shielding part 56 may be installed to overlap each other.

After adjusting the width of the shielding module 50, the user may lower the window 1 and, due to a self-load of the window 1, the shielding module 50 is fixed between a window frame 2 and the window 1.

Thereafter, the user may operate the operation button 35 provided in the case 10 to actuate the air-conditioner.

When the air-conditioner is driven, indoor air is intaken through the inlet 11. A portion of the intaken indoor air passes through a condenser.

Air heat-exchanged with the condenser flows to the exhaust pipe 22 through the exhaust pipe fixing part 42 of the rear case 40 and is guided to the shielding module 50 along the exhaust pipe 22.

Discharged air guided to the shielding module 50 is outwardly discharged through the first shielding part 52.

Thereafter, when the exhaust unit 20 is received, the user may slidably move the first shielding part 52, the second shielding part 54, and the third shielding part 56 of the shielding module 50 such that the first shielding part 52, the second shielding part 54, and the third shielding part 56 overlap to each other so as to be disposed in the original state.

Thereafter, the user inserts the stacked shielding module 50 into the shielding coupling recess 46.

The shielding module 50 is inserted in a traverse direction into the shielding coupling recess 46, movement thereof in a longitudinal direction is limited.

After the shielding module 50 is inserted, the permanent magnet 48 and the magnetic force corresponding member 49 generate attraction to each other to fix the shielding module 50.

The permanent magnet 48 and the magnetic force corresponding member 49 restrain the shielding module 50 from moving in a traverse direction.

When the shielding module 50 is inserted into the shielding coupling recess 46, the exhaust pipe 22 is also inserted into the exhaust pipe insertion recess 44.

Accordingly, the exhaust unit 20 may be simply received in the case 10.

Here, since a portion of the exhaust unit 20 is inserted into an inner side of the rear case 40, protruding of the exhaust unit 20 from the back of the case 100 may be minimized.

Also, since a portion of the exhaust unit 20 is inserted into an inner side of the rear case 40, center of gravity may be stably maintained.

In a case in which the exhaust unit 20 is simply installed on an outer side of the rear case 40, rather than being inserted into an inner side of the depressed rear case 40, the center of gravity is moved to the back side of the case 10.

In a state in which the center of gravity is moved to the back side of the case 10, when an external impact is applied, the case 10 may collapse to the back side, potentially damaging the product or causing an accident.

A second embodiment of the present discourse will be described with reference to FIG. 8.

Figure 8:
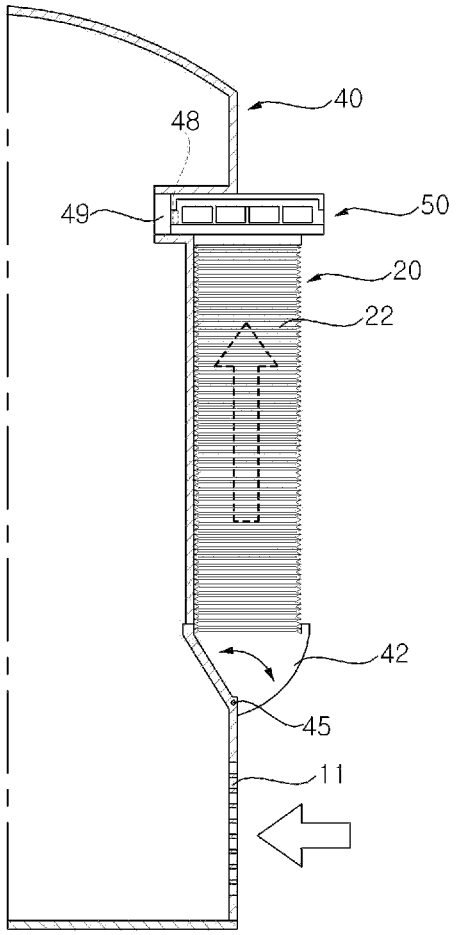
FIG. 8 is a cross-sectional view illustrating a coupling structure of an exhaust unit according to a second embodiment of the present disclosure.

Referring to FIG. 8, the exhaust unit 20 according to the present disclosure is configured to rotate at a predetermined angle with respect to the rear case 40.

More specifically, the exhaust pipe fixing part 42 connecting the exhaust pipe 22 and the rear case 40 may rotate at a predetermined angle with respect to the rear case 40.

To this end, an exhaust pipe rotation shaft 45 is formed between the exhaust pipe fixing part 42 and the rear case 40.

The exhaust pipe rotation shaft 45 is disposed at a lower portion of the exhaust pipe fixing part 42.

An upper portion of the exhaust pipe fixing part 42 may be rotated centered on the exhaust pipe rotation shaft 45.

Accordingly, in a case in which the exhaust unit 20 is installed, when the exhaust pipe 22 is drawn out, the exhaust pipe fixing part 42 is rotated centered on the exhaust pipe rotation shaft 45.

Although not shown, an exhaust pipe stopper limiting a rotation angle of the exhaust pipe fixing part 42 may be formed.

The exhaust pipe stopper may be formed in any one of the rear case 40 and the exhaust pipe fixing part 42.

A maximum rotation angle of the exhaust pipe fixing part 42 may be set to about 45 degrees.

Other components are the same as those of the first embodiment, and thus, a detailed description thereof will be omitted.

A third embodiment of the present disclosure will be described with reference to FIG. 9.

Figure 9:
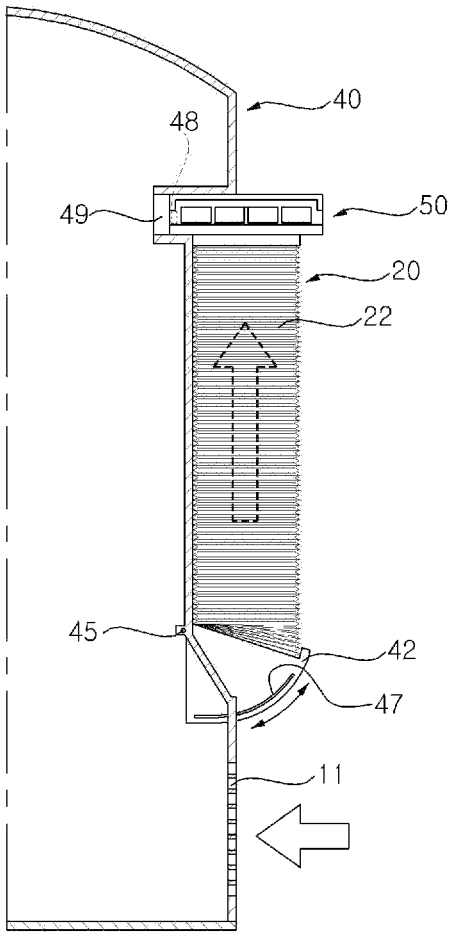
FIG. 9 is a cross-sectional view illustrating a coupling structure of an exhaust unit according to a third embodiment of the present disclosure.

Referring to FIG. 9, the exhaust pipe fixing part 42 according to the present disclosure is configured to be rotated while being inserted into an inner side of the rear case 40, unlike the second embodiment.

To this end, the exhaust pipe rotation shaft 45 is disposed above the exhaust pipe fixing part 42.

A lower portion of the exhaust pipe fixing part 42 is rotated centered on the exhaust pipe rotation shaft 45 disposed thereabove.

In order to guide rotation of the exhaust pipe fixing part 42, a fixing part guide 47 is formed in the exhaust pipe fixing part 42.

The fixing part guide 47 has a circular arc shape.

A guide protrusion (not shown) corresponding to the fixing part guide may be formed in the rear case 40.

Accordingly, when the exhaust pipe 22 is drawn out to install the exhaust unit 20, the exhaust pipe fixing part 42 is rotated while being inserted into the rear case 40.

In this structure, the exhaust pipe fixing part 42 may be naturally rotated according to a load applied to the exhaust pipe fixing part 42.

In particular, an effect of distributing a load acting on the exhaust pipe fixing part 42 to the exhaust pipe rotation shaft 45, the fixing part guide 47, and the guide protrusion may be obtained.

Other components are the same as those of the second embodiment, and thus, a detailed description thereof will be omitted.

The embodiments have been described with reference to the accompanying drawings, but various modifications may be made without being limited thereto and it will be understood by those of skill in the art that various changes in form and details may be made without departing from the spirit and scope of the present invention as set forth in the following claims. Therefore, the embodiments described above are merely illustrative and should not be understood as a limitation of the present disclosure.

What is claimed is:

1. An air-conditioner, comprising:

a case having an inlet portion and an outlet portion; and a shielding coupling recess that is formed in the case and recessed inwardly toward the case;

an exhaust pipe that is attached to the case, the exhaust pipe having a first portion and a second portion, whereby an end of the first portion is provided at least partially inside the case, and the second portion is arranged as a free end, the first portion being positioned lower than the shield coupling recess; and a shield that is attached to an end of the second portion and detachably coupled to the case, the shield configured to discharge air flowing through the exhaust pipe;

wherein the shield is configured to hook on the shielding coupling recess by a self-load of the shield and the exhaust pipe, wherein the shield comprises:

a first shielding part attached to the exhaust pipe, the first shielding part having an opening to communicate with the exhaust pipe and discharge air guided through the exhaust pipe;

a second shielding part attached to the first shielding part, the second shielding part configured to slide along the first shielding part; and a third shielding part that is attached to the second shielding part and configured to slide along the second shielding part, wherein the first shielding part, the second shielding part, and the third shielding part are provided in a stacked state configured to be inserted into the shielding coupling recess, and the shield forms a mutual arrest with the shielding coupling recess.

2. The air conditioner of claim 1, further comprising a stopper to limit the slidable movement of the second shielding part, the stopper being provided in the first shielding part or the second shielding part.

3. The air conditioner of claim 1, wherein a mesh structure is provided in the opening, and air heat-exchanged with a condenser is discharged through the mesh structure.

4. The air conditioner of claim 1, further comprising a rail and a guide, wherein the rail is formed on the first shielding part and the guide is formed on the second shielding part, or wherein the rail is formed on the second shielding part and the guide is formed on the first shielding part.

5. The air conditioner of claim 4, further comprising a stopper to limit slidable movement of the guide, the stopper being provided on the rail.

6. The air conditioner of claim 1, wherein the exhaust pipe is a corrugate tube with grooves formed in a lengthwise direction.

7. The air conditioner of claim 6, wherein the grooves are formed in a longitudinal direction.

8. The air conditioner of claim 6, wherein the exhaust pipe is oval shaped, and an exhaust pipe insertion recess into which the exhaust pipe is inserted is formed in the case.

9. The air conditioner of claim 8, wherein the exhaust pipe and the shield are attached together and form a T-shape.

10. The air conditioner of claim 9, wherein the shield is horizontally provided in the shielding coupling recess.

11. The air conditioner of claim 10, wherein the shielding coupling recess is connected to the exhaust pipe insertion recess.

12. The air conditioner of claim 1, wherein an entire width of the first shielding part, the second shielding part, and the third shielding part is partially inserted into the shielding coupling recess.

13. The air conditioner of claim 1, wherein the first shielding part is attached to the exhaust pipe, the second shielding part is slidably attached to the first shielding part, and the third shielding part is slidably attached to the second shielding part.

* * * * *